US009730295B2

(12) United States Patent
Kim et al.

(10) Patent No.: US 9,730,295 B2
(45) Date of Patent: Aug. 8, 2017

(54) ELECTRONIC DEVICE AND METHOD OF BONDING THE SAME

(71) Applicant: SAMSUNG DISPLAY CO., LTD., Yongin-si, Gyeonggi-Do (KR)

(72) Inventors: Taesik Kim, Seoul (KR); Hyeondeuk Hwang, Cheonan-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 0 days.

(21) Appl. No.: 14/944,765

(22) Filed: Nov. 18, 2015

(65) Prior Publication Data

US 2016/0212823 A1 Jul. 21, 2016

(30) Foreign Application Priority Data

Jan. 15, 2015 (KR) ..... 10-2015-0007594

(51) Int. Cl.

| | |
|---|---|
| ***H05B 33/10*** | (2006.01) |
| ***H05B 33/22*** | (2006.01) |
| ***H05B 33/06*** | (2006.01) |
| ***H05B 33/14*** | (2006.01) |

(52) U.S. Cl.

CPC ..... *H05B 33/22* (2013.01); *H05B 33/06* (2013.01); *H05B 33/10* (2013.01); *H05B 33/145* (2013.01)

(58) Field of Classification Search

CPC ..... H05B 33/22; H05B 33/145; H05B 33/10; H05B 33/06

See application file for complete search history.

(56) References Cited

U.S. PATENT DOCUMENTS

| | | | | |
|---|---|---|---|---|
| 5,843,251 | A * | 12/1998 | Tsukagoshi | H01L 21/563 156/295 |
| 6,294,270 | B1 * | 9/2001 | Clough | C08G 59/027 257/E23.119 |
| 2005/0110406 | A1 * | 5/2005 | Jeong | H01R 12/62 313/582 |
| 2008/0131685 | A1 * | 6/2008 | Lee | H01B 1/22 428/327 |
| 2013/0118672 | A1 * | 5/2013 | Park | H05K 3/323 156/73.1 |
| 2014/0226883 | A1 | 8/2014 | Hong et al. | |
| 2016/0093684 | A1 * | 3/2016 | Youk | H01L 27/3272 257/40 |

FOREIGN PATENT DOCUMENTS

| | | | |
|---|---|---|---|
| JP | 2008-153201 | A | 7/2008 |
| KR | 10-2007-0013474 | A | 1/2007 |
| KR | 10-2011-0006008 | A | 1/2011 |
| KR | 10-1354875 | B1 | 1/2014 |
| KR | 10-2014-0078557 | A | 6/2014 |

* cited by examiner

*Primary Examiner* — Donald Raleigh
(74) *Attorney, Agent, or Firm* — Lee & Morse, P.C.

(57) ABSTRACT

An electronic device including a first electronic component including a first pad unit, a second electronic component electrically connected to the first electronic component, the second electronic component including a second pad unit connected to the first pad unit, and a conductive adhesion film that couples the first pad unit to the second pad unit. The conductive adhesion film includes an adhesion resin layer, a conductive ball dispersed in the adhesion resin layer, and a curing agent capsule dispersed in the adhesion resin layer, the curing agent capsule including a curing initiator and a tube that seals the curing initiator.

11 Claims, 8 Drawing Sheets

ELECTRONIC DEVICE AND METHOD OF BONDING THE SAME

CROSS-REFERENCE TO RELATED APPLICATION

Korean Patent Application No. 10-2015-0007594, filed on Jan. 15, 2015, in the Korean Intellectual Property Office, and entitled: "Electronic Device and Method of Bonding the Same," is incorporated by reference herein in its entirety.

BACKGROUND

1. Field

Embodiments relate to an electronic device and a method bonding the same.

2. Description of the Related Art

Generally, an electronic device includes two or more electronic components.

For example, electronic devices such as a mobile phone, a notebook computer, and a television may include an electric optical panel, a main wiring board, and a flexible wiring board. The two or more electronic components may be electrically connected to each other.

SUMMARY

Embodiments are directed to an electronic device including a first electronic component including a first pad unit, a second electronic component electrically connected to the first electronic component, the second electronic component including a second pad unit connected to the first pad unit, and a conductive adhesion film that couples the first pad unit to the second pad unit. The conductive adhesion film includes an adhesion resin layer, a conductive ball dispersed in the adhesion resin layer, and a curing agent capsule dispersed in the adhesion resin layer, the curing agent capsule including a curing initiator and a tube that seals the curing initiator.

The adhesion resin layer may include an epoxy resin or an acryl resin.

The conductive ball may be provided as a plurality of conductive balls. The conductive balls electrically connect the first pad unit to the second pad unit.

The curing agent capsule may have a spherical shape and a diameter that is greater than that of the conductive balls and less than a thickness of the adhesion resin layer.

The curing initiator may include at least one of an isocyanate-based curing agent, an amine-based curing agent, and an aziridine-based curing agent.

The tube may include at least one of a melamine resin, an urethane resin, an acrylic resin, and an epoxy resin.

The first electronic component may include an electric optical panel or a wiring board. The second electronic component may include a flexible wiring board.

Embodiments are also directed to a method of bonding an electronic device, the method including aligning a pad unit of a first electronic component and a pad unit of a second electronic component, and attaching the pad unit of the first electronic component to the pad unit of the second electronic component by applying a pressure. Attaching the pad unit of the first electronic component to the pad unit of the second electronic component includes pre-compressing the pad unit of the first electronic component to the pad unit of the second electronic component, and applying a pressure to the pad unit of the first electronic component and the pad unit of the second electronic component.

The pad unit of the first electronic component and the pad unit of the second electronic component may be disposed to face each other with a conductive adhesion film therebetween.

The conductive adhesion film may include an adhesion resin layer, a conductive ball dispersed in the adhesion resin layer, and a curing agent capsule dispersed in the adhesion resin layer, the curing agent capsule including a curing initiator and a tube that seals the curing initiator.

Applying the pressure to the pad unit of the first electronic component and the pad unit of the second electronic component may include applying a pressure of about 5 Mpa to about 150 Mpa.

Applying the pressure to the pad unit of the first electronic component and the pad unit of the second electronic component may include applying pressure such that the tube is broken.

After the tube is broken, the curing initiator may react with the adhesion resin layer to cure the adhesion resin layer.

Aligning the pad unit of the first electronic component and the pad unit of the second electronic component may include aligning an alignment mark of the first electronic component and an alignment mark of the second electronic component.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
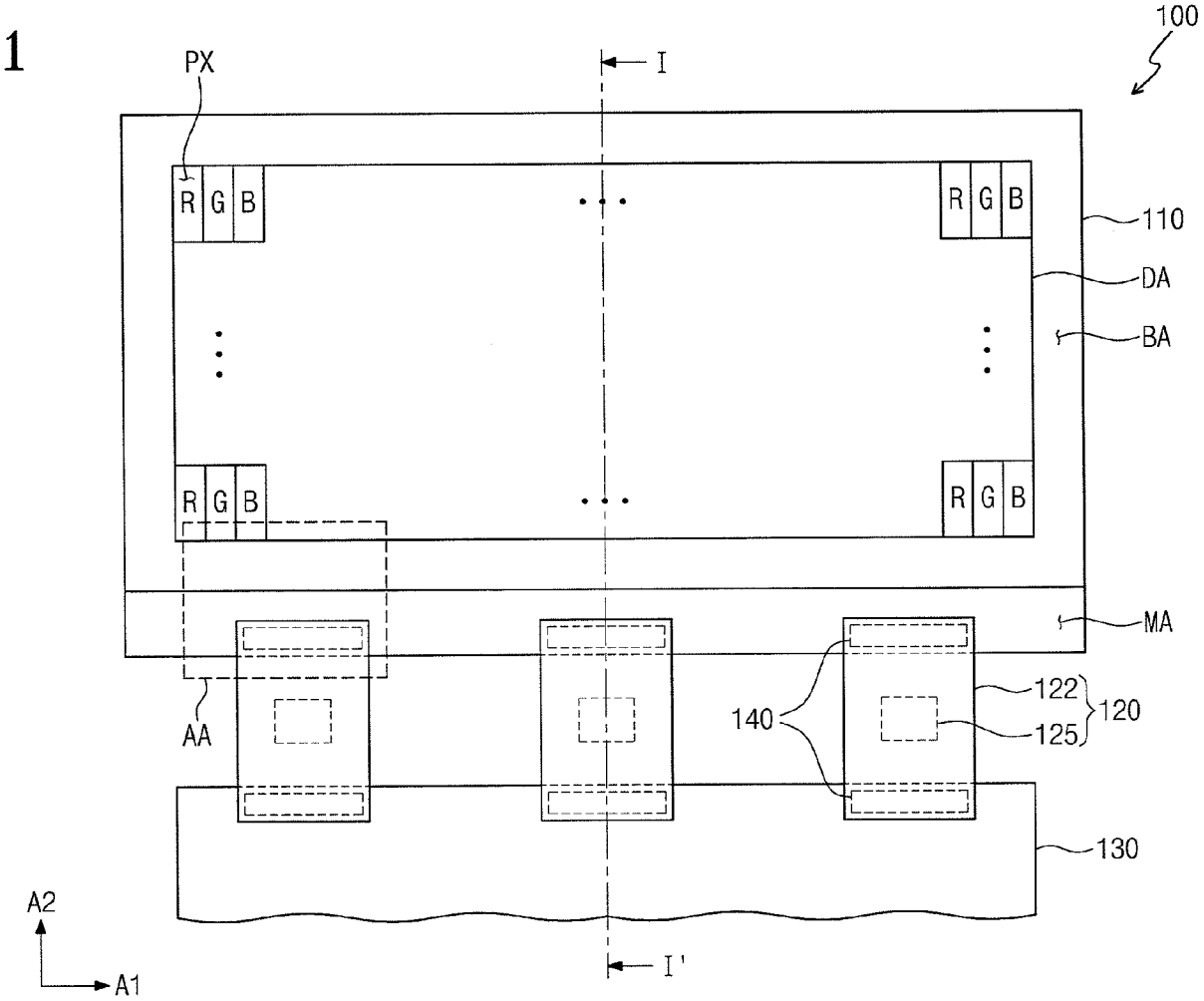
FIG. 1 illustrates a plan view depicting an electronic device according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another element, it can be directly on the other layer or element, or intervening layers or elements may also be present. Further, it will be understood that when a layer or element is referred to as being "between" two layers or elements, it can be the only layer or element between the two layers or elements, or one or more intervening layers of elements may also be present. Like reference numerals refer to like elements throughout.

Hereinafter, specific embodiments will be described in more detail with reference to the accompanying drawings.

Figure 2:
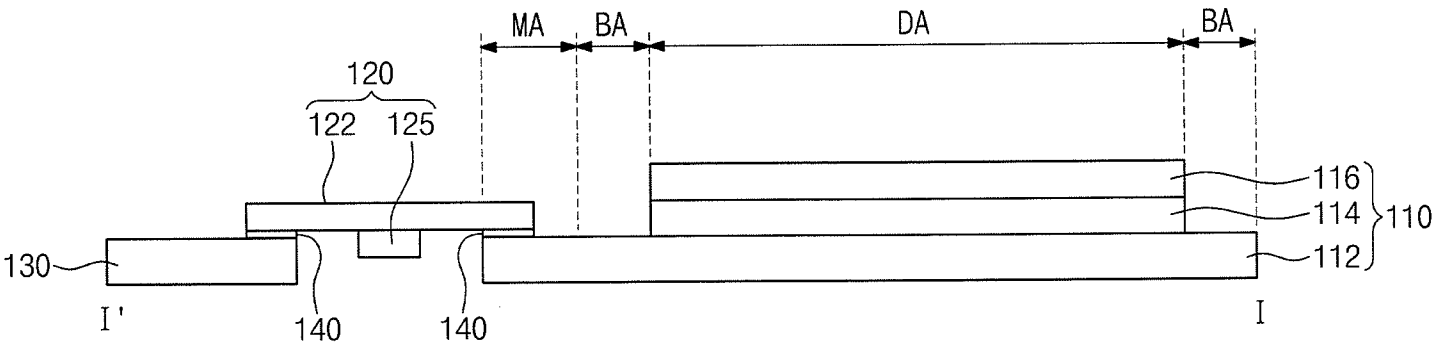
FIG. 2 illustrates a cross-sectional view taken along line I-I' of FIG. 1.
Figure 3A:
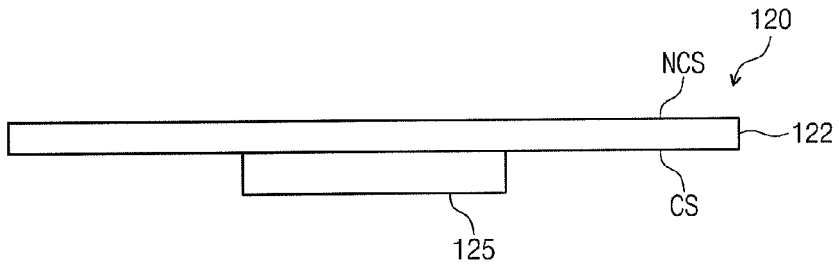
FIG. 3A illustrates a side view depicting a second electronic component according to an embodiment.
Figure 3B:
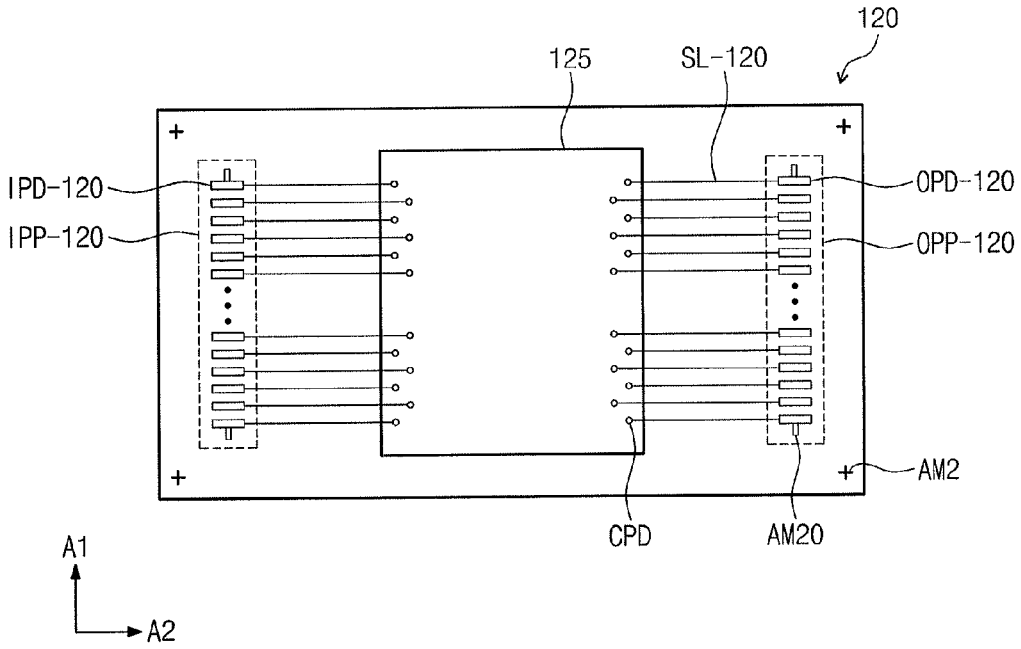
FIG. 3B illustrates a plan view depicting a second electronic component according to an embodiment.

FIG. 1 illustrates a plan view depicting an electronic device according to an embodiment, and FIG. 2 illustrates a cross-sectional view taken along line I-I' of FIG. 1. FIG. 3A illustrates a side view depicting a second electronic component according to an embodiment, and FIG. 3B illustrates a plan view depicting a second electronic component according to an embodiment.

Referring to FIGS. 1 and 2, an electronic device 100 according to an embodiment may include first to third electronic components 110, 120, and 130. The first to third electronic components 110, 120, and 130 may be electrically connected. The first to third electronic components 110, 120, and 130 may include an electric optical panel, a connection wiring board, and a main circuit board, respectively. The electronic device 100 may include at least one second electronic component 120 according to a use and dimension thereof. For example, the electronic device 100 may include three second electronic components 120, as exemplarily illustrated. In some implementations, As illustrated in FIG. 1, the electric optical panel 110 (hereinafter, referred to as a display panel) may be a display panel that is configured to display a desired image by applying a driving signal to a plurality of pixels PX. The plurality of pixels PX may be disposed in a matrix configuration along a first direction axis A1 and a second direction axis A2 perpendicular to the first direction axis A1. In an embodiment, the pixels PX may include first to third pixels that respectively display a red color R, a green color G, and a blue color. In some implementations, the pixels PX may further include a portion of pixels that respectively display white, cyan, and magenta. The plurality of pixels PX may be defined as a display unit of the display panel 110.

The display panel 110 may be classified as a liquid crystal display panel, an organic light-emitting display panel, an electrowetting display panel, or the like according to species of the pixels PX. For example, the display panel 110 may be an organic light-emitting display panel.

The display panel 110 may be divided into a display area DA on which the plurality of pixels PX are located, a non-display area BA surrounding the display area DA, and a mounting area MA to which the second electronic device is coupled 120. In some implementations, the non-display area BA and the mounting area MA may not be divided. In some implementations, the non-display area BA may be omitted, or the mounting area MA may be a portion of the non-display area BA.

As illustrated in FIG. 2, the display panel 110 may include a display substrate 112, a display device layer 114 disposed on the display substrate 112, and an encapsulating layer 116 disposed on the display device layer 114. The display substrate 112 may include a base substrate, and a plurality of insulation layers, functional layers, and conductive layers, which are disposed on the base substrate. The conductive layer may include gate wirings, data wirings, and signal wirings. Also, the conductive layer may be include a pad unit connected to the wirings. The wirings may supply a driving signal to the plurality of pixels PX.

The display device layer 114 may include a plurality of insulation layers, functional layers, and conductive layers to constitute the plurality of pixels PX. The functional layer may include an organic light-emitting layer. The encapsulating layer 116 may be disposed on the display device layer 114. The encapsulating layer 116 may protect the display device layer 114. In some implementations, the encapsulating layer 116 may cover a side surface of the display device layer 114. The encapsulating layer 116 may be omitted, or may be replaced by another substrate according a species of the display panel 110.

A black matrix that blocks out light may be disposed on the non-display area BA. A gate driving circuit that supplies a gate signal to the plurality of pixels PX may be provided on the non-display area BA. In an embodiment, the gate driving circuit may be further provided on the non-display area BA. A pad unit that receives a signal supplied from the second electronic component 120 may be disposed on the mounting area MA.

As illustrated in FIGS. 1 and 2, the second electronic component 120 may include a flexible wiring board 122 and a data driving circuit 125. The data driving circuit 125 may include at least one driving chip. For example, the second electronic component 125 may have a chip on film structure. The data driving circuit 125 may be electrically connected to wirings of the flexible wiring board 122.

When the second electronic component 120 includes the data driving circuit 125, a pad unit of the display panel 110 may include data pads electrically connected to the data wirings and control signal pads electrically connected to the control signal wirings. The data wirings may be connected to the pixels PX, and the control signal wirings may be connected to the data driving circuit.

The second electronic component 120 may be described in more detail with reference to FIGS. 3A and 3B. The flexible wiring board 122 may include an insulation layer, a plurality of pads CPD, IPD-120, and OPD-120, and a plurality of wirings SL-120. The plurality of pads CPD, IPD-120, and OPD-120 and the plurality of wirings SL-120 may be disposed on the insulation layer. The insulation layer may include polyimide.

The plurality of pads CPD, IPD-120, and OPD-120 may include connection pads CPD connected to connection terminals of the data driving circuit 125, input pads IPD-120 connected to the third electronic components 130, and output pads OPD-120 connected to the display panel 110. The input pads IPD-120 may be disposed on one side of the flexible wiring board 122, and the output pads OPD-120 may be disposed on another side of the flexible wiring board 122. In the present embodiment, the connection pads CPD may be overlappingly aligned on both sides of the data driving circuit 125. In some implementations, the connection pads CPD may be randomly arranged so as to correspond to the connection terminals of the data driving circuit 125.

In some implementations, the input pad unit IPP-120 and the output pad unit OPP-120 may each be made up of one pad row, as exemplarily illustrated. The pad row may include a plurality of pads arranged along the first direction axis A1. In some implementations, each of the input pad unit IPP-120 and the output pad unit OPP-120 may include a plurality of pad rows.

Some of the wirings SL-120 may connect the connection pads CPD and the input pads IPD-120, and the others of the wirings SL-120 may connect the connection pads CPD and the output pads OPD-120. The wirings SL-120 may each directly connect to one of the input pads IPD-120 or one of the output pads OPD-120.

The flexible wiring board 122 may further include a solder resist layer that is disposed on the insulation layer to at least cover the plurality of wirings SL-120. The solder resist layer may cover surrounding of the plurality of pads CPD, IPD-120, and OPD-120 and each of the plurality of pads CPD, IPD-120, and OPD-120 may be exposed. Openings may be formed on the solder resist layer so as to correspond to the plurality of pads CPD, IPD-120, and OPD-120.

The flexible wiring board 122 may include alignment marks AM2 and AM20 to be used in a bonding process, as described below. FIG. 3 exemplarily illustrates four first alignment marks AM2 spaced apart from the plurality of pads CPD, IPD-120, and OPD-120, and four second alignment marks AM20 connected to the input pads IPD-120 and the output pads OPD-120. In some implementations, at least one of the first and second alignment marks AM2 and AM20 may be omitted.

A surface through which the input pads IPD-120 and the output pad unit OPD-120 are exposed may be defined as a coupling surface CS, and a surface opposed to the coupling surface may be defined as a non-coupling surface NCS. The data driving circuit 125 may be disposed on the coupling surface CS, as illustrated. In some implementations, the data driving circuit 125 may be disposed on the non-coupling surface NCS.

Referring to FIGS. 1 and 2, the third electronic component 130 may supply image data, a control signal, a power voltage, or the like, to the display panel 110 or to the data driving circuit 125. The third electronic component 130 may be a board that is different from the flexible wiring board 122. The third electronic component 130 may include active elements and passive elements. The third electronic component 130 may be a flexible wiring board or a rigid wiring board and may includes a pad unit connected the flexible wiring board 122.

Referring to FIGS. 1 to 3B, the output pad unit OPP-120 of the flexible wiring board 122 and the pad unit of the display panel 110 may be electrically connected by the conductive adhesion film 140. The input pad unit IPP-120 of the flexible wiring board 122 and the pad unit of the third electronic component 130 may be also electrically connected by the conductive adhesion film 140. The conductive adhesion film 140 may be an anisotropic conductive film (ACF). In an implementation, a solder bump may be substituted for the conductive adhesion film 140.

The pad unit of the display panel 110 may include pads corresponding to the output pads OPD-120 of the flexible wiring board 122. The pad unit of the third electronic component 130 may include pads corresponding to the input pads IPD-120 of the flexible wiring board 122.

Hereinafter, electrical connection structures of the first to third electronic components 110, 120, and 130 may be described in more detail with reference to the pad unit of the display panel 110 and the output pad unit OPP-120 of the flexible wiring board 122. An electrical connection structure of the second electronic component 120 and the third electronic component 130 may correspond to an electric connection structure of the pad unit of the display panel 110 and the output pad unit OPP-120 of the flexible wiring board 122. Also, although it is described that the electronic device 100 according to the present embodiment includes the first to third electronic components 110, 120, and 130, any one of the first electronic component 110 and the third electronic component 130 may be omitted.

Figure 4A:
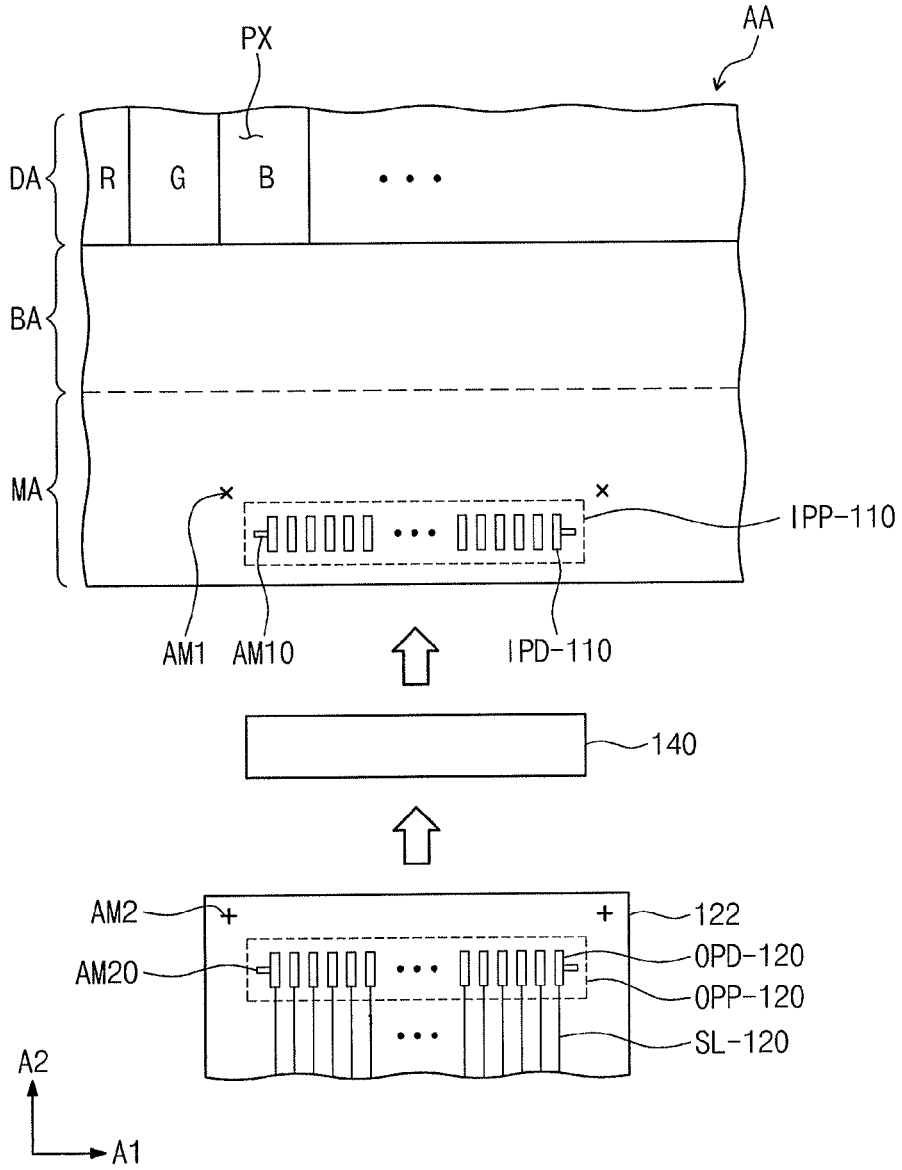
FIG. 4A illustrates a plain view depicting separated pad units illustrated two electronic components illustrated in FIG. 1.
Figure 4B:
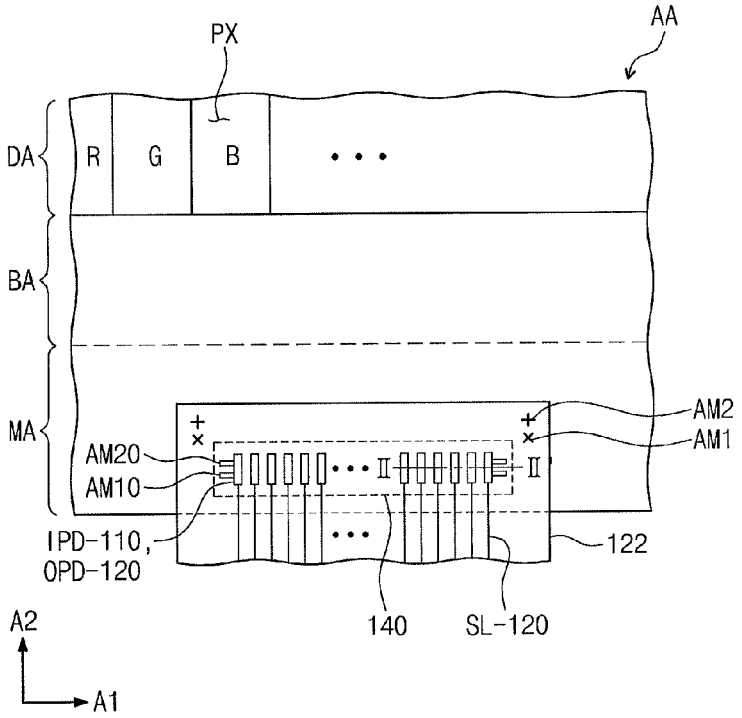
FIG. 4B illustrates a plain view depicting coupled pad units illustrated two electronic components illustrated in FIG. 1.
Figure 4C:
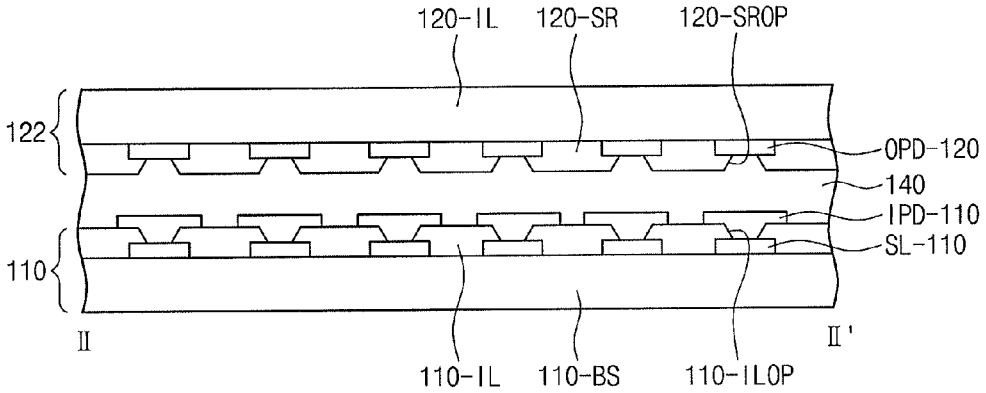
FIG. 4C illustrates a cross-sectional view taken along line II-II' illustrated in FIG. 4B.

FIG. 4A illustrates a plain view depicting separated pad units of two of the electronic components illustrated in FIG. 1. FIG. 4B illustrates a plain view depicting coupled pad units of two of the electronic components illustrated in FIG. 1. FIG. 4C illustrates a cross-sectional view taken along line II-II' of FIG. 4B.

As shown in FIG. 4A, the display panel 110 may include an input pad unit IPP-110 corresponding to the output pads OPP-120 of the flexible wiring board 122. The input pad unit IPP-110 may include input pads IPD-110 corresponding to the output pads OPD-120 of the flexible wiring board 122. In FIG. 4A, it is illustrated that the input pads IPD-110 and the output pads OPD-120 correspond to each other on a one-to-one basis. In some implementations, the input pad unit IPP-110 and the output pad unit OPP-120 may include different numbers of pads and the different numbers of pad rows.

The display panel 110 may include first and second alignment marks AM1 and AM10 corresponding to the first and second alignment marks AM2 and AM20 of the flexible wiring board 122. Any one of the first and second alignment marks AM1 and AM10 of the display panel 110 may be omitted.

As illustrated in FIG. 4B, the output pads OPD-120 of the flexible wiring board 122 and the input pads IPD-110 of the display panel 110 may be electrically connected. The output pad unit OPP-120 and the input pad unit IPP-110 may be aligned by using the first and second alignment marks AM2 and AM20 of the flexible wiring board 122 and the first and second alignment marks AM1 and AM10 of the display panel 110. In addition, an alignment correction may be performed along the second direction axis A2. The aligned output pads OPD-120 and input pads IPD-110 may be coupled to each other with the conductive adhesion film 140 in-between by using a tool.

As illustrated in FIG. 4C, signal wirings SL-110 may be disposed on a base substrate 110-BS of the display panel 110. An insulation layer 110-IL may be disposed on the base substrate 110-BS. The insulation layer 110-IL may include a barrier layer, a passivation layer, or the like. The input pads IPD-110 may be disposed on the insulation layer 110-IL, and may be connected to the signal wirings SL-110 through through-holes 110-ILOP defined in the insulation layer 110-IL.

The wirings SL-120 (see FIG. 4B) and the output pads OPD-120 connected the wirings SL-120 may be disposed on the insulation layer 120-IL of the flexible wiring board 122. The wirings SL-120 and the output pads OPD-120 may be disposed on the same layer. In some implementations, the wirings SL-120 and the output pads OPD-120 may be disposed on different layers with another insulation layer in-between. The wirings SL-120 and the output pads OPD-120 may be connected through-holes formed in another insulation layer.

A solder resist layer 120-SR may be disposed on the insulation layer 120-IL. The output pads OPD-120 may be exposed through through-holes 120-SROP formed in the solder resist layer 120-SR. In an embodiment, the solder resist layer 120-SR may cover only the wirings SL-120, and may not cover the output pads OPD-120.

The output pads OPD-120 and the input pads IPD-110 may be electrically connected through the conductive adhesion film 140. Among the output pads OPD-120 and the input pads IPD-110, an output pad and an input pad corresponding to each other may be electrically connected through a plurality of conductive balls included in the conductive adhesion film 140.

Figure 5:
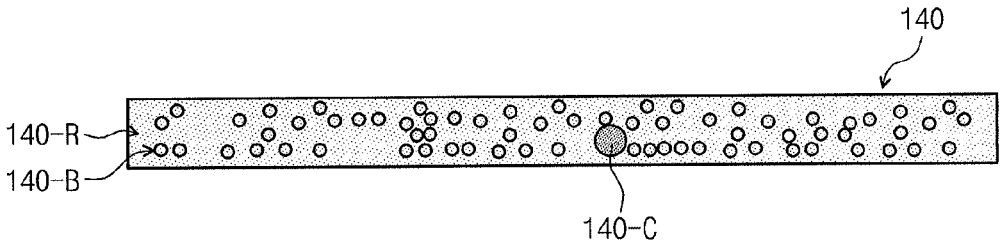
FIG. 5 illustrates a cross-sectional view depicting a conductive adhesion film.
Figure 6:
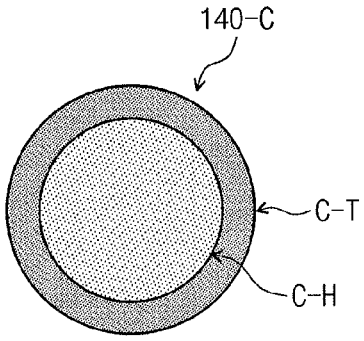
FIG. 6 illustrates a cross-sectional view depicting a curing agent capsule.

FIG. 5 illustrates a cross-sectional view depicting a conductive adhesion film, and FIG. 6 illustrates a cross-sectional view depicting a curing agent capsule. The conductive adhesion film 140 may be described in detail with reference to the accompanying drawings.

As illustrated in FIG. 5, the conductive adhesion film 140 may include an adhesion resin layer 140-R, a conductive ball 140-B, and a curing agent capsule 140-C.

The adhesion resin layer 140-R may include an insulating polymer. For example, an epoxy resin, an acryl resin, or the like may be used as the insulating polymer. The epoxy resin may include bisphenol A and a phenoxy polymer having a repeated structure of an ether linkage (—C—O—C—), and an epoxy reactor on a terminal portion thereof. The acryl resin may be include a urethane(meta)acrylate polymer having a urethane linkage (—NHCO—O) connection structure and an acrylate reactor or a methacrylate reactor on the terminal portion thereof.

The adhesion resin layer 140-R may further include a filler, softener, accelerant, colorant, flame resistant agent, light stabilizer, cross-linking agent, polymerization preventing agent, or the like.

The conductive ball 140-B may be provided in plurality. The conductive ball 140-B may be dispersed inside the adhesion resin layer 140-R. The conductive ball 140-B may be provided as conductive fine particles that are able to carry electricity. For example, the conductive fine particles may be conductive particles, such as a metal or an oxide of the metal, or may be particles in which a metal or an oxide of the metal is coated on a surface of an insulating material core. Nickel, iron, copper, aluminum, tin, zinc, chromium, cobalt, silver, gold, or the like, may be used as the metal.

The curing agent capsule 140-C may be provided in plurality. The curing agent capsule 140-C may be dispersed inside the adhesion resin layer 140-R. The curing agent capsule 140-C may have a suitable shape. For example, the curing agent capsule 140-C may have a spherical or circular shape, and may have a diameter greater than that of the conductive ball 140-B and smaller than a thickness of the adhesion resin layer 140-R. In some implementations, the curing agent capsule may have an oval shape.

As illustrated in FIG. 6, the curing agent capsule 140-C may include a curing initiator C—H and a tube C-T that seals the curing initiator C—H.

The curing initiator C—H may react with the adhesion resin layer 140-R to cure the adhesion resin layer 140-R. The curing initiator C—H may be an isocyanate-based curing agent, an amine-based curing agent, or an aziridine-based curing agent, as examples.

For example, the isocyanate-based curing agent may include hexamethylene diisocyanate (HDI), isophorone diiosocyanate (IPDI), bis-(4-isocyanatocyclohexyl)methane (HMDI), 2,4- or 2,6-toluene diisocyanate (TDI), diphenylmethane-4,4'-and/or -2,4'-diisocyanate (MDI), xylene diisocyanate (XDI), tetramethylxylene diisocyanate (TMXDI), triisocyanatononane (TIN), or the like.

The amine-based curing agent may include diethylenetriamine (DTA), triethylenetetramine (TTA), tetraethylenepentamine (TEPA), dipropylenediamine (DPDA), diethylaminopropylamine (DEAPA), menthane diamine (MDA), isophoronediamine (IPDA), metaphenylene diamine (MPDA), diaminodiphenylmethane (DDM), diaminodiphenylsulfone (DDS), or the like.

The aziridine-based curing agent may include trimethylolpropane tris(2-methyl-1-aziridine propionate), trimethylolpropane tris(13-N-aziridinyl) propionate, pentaerythritol tris[3-(1-aziridinyl)propionate], pentaerythritol tris(2-methyl-1-aziridine propionate) or the like.

The tube C-T may separate the curing initiator C—H and the adhesion resin layer 140-R before the curing initiator C—H reacts with the adhesion resin layer 140-R. The tube C-T may be provided in a size of several nanometers nm to several hundred micrometers μm, and may have a diameter greater than that of the conductive ball 140-B. The tube C-T may be formed of an insulating material. The insulating material may include a melamine resin, an urethane resin, an acryl resin, an epoxy resin, or the like.

The curing agent capsule 140-C may be formed through an interface neutralizing process, a curing and coating process, a coacervation process, an interface precipitation process, a co-extrusion process or the like.

The interface neutralizing process may utilize an interface reaction of a hydrophobic monomer and a hydrophilic monomer. For example, the interface reaction may be a reaction between a first hydrophilic monomer dissolved in oil, for example, dissolved in an organic solvent that is not mixed with water, and a second hydrophilic monomer that is added to the first hydrophilic monomer dissolved in oil. When the resultant mixture is stirred, a polymerization reaction may occur on an interface of water and oil to generate a polymer membrane. The oil may be confined in the generated membrane, and resultantly, an oil-containing microcapsule is prepared.

The curing and coating process may be a process in which a surface of a material having a predetermined size is capsulated with a coating material, and then a coating is introduced into a curing liquid to be cured, and resultantly, a capsule is prepared. The curing and coating process may utilize a pre-prepared polymer. A coating material may be more easily selected, compared to the interface neutralizing method.

In the coacervation process, a capsule may be prepared by using a phenomenon in which a molecular solution is separated into a phase having a high concentration and a phase having a low concentration by adding foreign substances.

In the curing agent capsule 140-C, when a predetermined pressure is applied to the curing agent capsule 140-C, the tube C-T may be broken, and thus, the curing initiator C—H sealed in the tube C-T may be leaked to the outside.

Hereinafter, a method of bonding an electronic device will be described with reference to FIG. 7A to 7D, which illustrate cross-sectional views of a conductive adhesion film sequentially depicting states of the conductive adhesion film according to the method of bonding of the electronic device. For convenience of description, a description of the electronic device will not be repeated.

An electronic device bonding method according to an embodiment may include aligning the pad unit of the first electronic component and the pad unit of the second electronic component and attaching the pad unit of the first electronic component and the pad unit of the second electronic component.

The pad unit of the first electronic component and the pad unit of the second electronic component may be disposed to face each other with the conductive adhesion film 140 therebetween. The pad unit of the first electronic component and the pad unit of the second electronic component may be aligned by using the first alignment mark of the first electronic component and the alignment mark of the second electronic component.

The attaching of the pad unit of the first electronic component and the pad unit of the second electronic component may include pre-compressing the pad unit of the first electronic component and the pad unit of the second electronic component and applying a pressure to the pad unit of the first electronic component and the pad unit of the second electronic component.

Figure 7A:
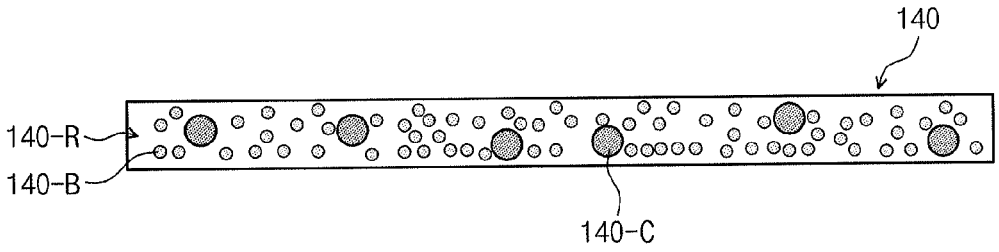
FIG. 7A to 7D illustrate cross-sectional view of a conductive adhesion film sequentially depicting a state of the conductive adhesion film according to a bonding of an electronic device.

The pad unit of the first electronic component and the pad unit of the second electronic component may be compressed to the conductive adhesion film 140. A pressure of about 1 Mpa to about 2 Mpa may be applied to the conductive adhesion film 140. As illustrated in FIG. 7A, the conductive adhesion film 140 may include the adhesion resin layer 140-R, the conductive ball 140-B, and the curing agent capsule 140-C.

Figure 7B:
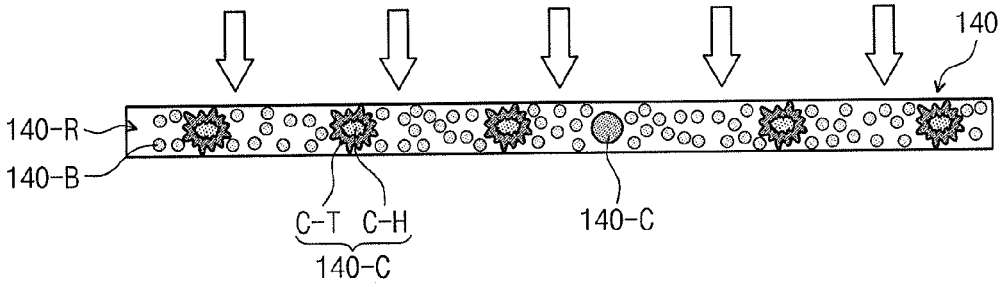

Pressure may be applied to the pad unit of the first electronic component and the pad unit of the second electronic component that are compressed to the conductive adhesion film 140. A pressure of about 5 Mpa to about 150 Mpa may be applied to the conductive adhesion film 140. As illustrated in FIG. 7B, the pressure may be applied to the curing agent capsule 140-C, and the tube C-T of the curing agent capsule 140-C may be broken.

Figure 7C:
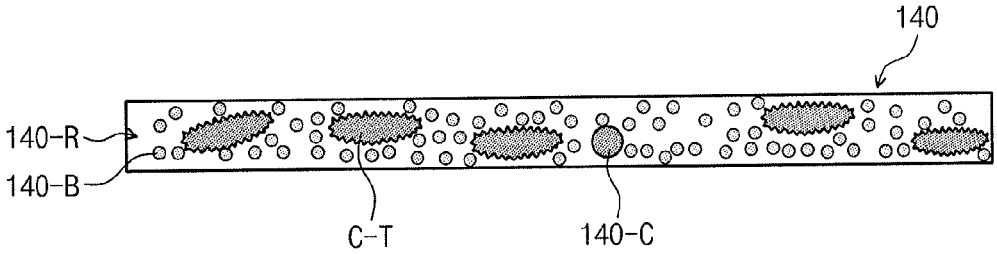

As illustrated in FIG. 7C, after the tube C-T is broken, the curing initiator C—H that is sealed in the tube C-T may leak out of the tube C-T, and thus may react with the adhesion resin layer 140-R. The tube C-T may remain in the adhesion resin layer 140-R in a broken state.

Figure 7D:
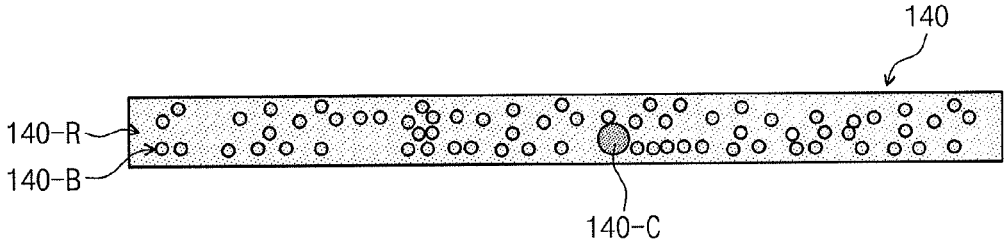

As illustrated in FIG. 7D, the adhesion resin layer 140-R may react with the curing initiator C—H, and thus may be cured. The conductive adhesion film 140 may maintain a state in which the pad unit of the first electronic component is adhered to the pad unit of the second electronic component. Although the curing agent capsule 140-C is shown as losing shape in the adhesion resin layer 140-R, in some implementations, a portion of the curing agent capsule 140-C may remain in the adhesion resin layer 140-R while the shape thereof may be maintained, according to the pressure applied to the pad unit of the first electronic component and the pad unit of the second electronic component in each of processes.

Generally, a method of curing a conductive adhesion film includes applying heat to the conductive adhesion film. In this case, the conductive adhesion film may be vulnerable to heat, and the temperature of the conductive adhesion film may need to be monitored and adjusted in temperature while being the conductive adhesion film is being stored or transferred.

However, according to an embodiment, the conductive adhesion film 140 may include the curing agent capsule 140-C. The conductive adhesion film 140 may be cured by pressure applied to the conductive adhesion film 140 during a coupling process. The conductive adhesion film 140 may be stored or transferred at a room temperature without a risk of premature curing. Also, may induce A curing reaction may be induce in the conductive adhesion film 140 in a low temperature process when pressure is applied.

By way of summation and review, two electronic components may be electrically connected to each other through the coupling of pad units. A process of electrically connecting the pad unit of the two electronic components (hereinafter, referred to as a bonding process) includes aligning and coupling the pad units of the two electronic components. According to an embodiment, an electronic device including a first electronic component and a second electronic component may be bonded by using the conductive adhesion film having stability.

According to the method of bonding the electronic device according to an embodiment, the method of easily attaching the first electronic component to the second electronic component may be provided.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope thereof the present invention as set forth in the following claims.

What is claimed is:

1. An electronic device, comprising:

a first electronic component including a first pad unit;

a second electronic component electrically connected to the first electronic component, the second electronic component including a second pad unit connected to the first pad unit; and a conductive adhesion film that couples the first pad unit to the second pad unit, the conductive adhesion film including:

an adhesion resin layer;

conductive balls dispersed in the adhesion resin layer; and curing agent capsules independently dispersed in the adhesion resin layer, the curing agent capsules including a curing initiator and a tube that seals the curing initiator, wherein the tube includes at least one of a melamine resin, a urethane resin, and an epoxy resin.

2. The electronic device as claimed in claim 1, wherein the adhesion resin layer includes an epoxy resin or an acryl resin.

3. The electronic device as claimed in claim 2, wherein:

the conductive balls electrically connect the first pad unit to the second pad unit.

4. The electronic device as claimed in claim 3, wherein the curing agent capsules have a spherical shape and a diameter that is greater than that of the conductive balls and less than a thickness of the adhesion resin layer.

5. The electronic device as claimed in claim 4, wherein the curing initiator includes at least one of an isocyanate-based curing agent, an amine-based curing agent, and an aziridine-based curing agent.

6. The electronic device as claimed in claim 1, wherein:

the first electronic component includes an electric optical panel or a wiring board, and the second electronic component includes a flexible wiring board.

7. A method of bonding an electronic device, the method comprising:

aligning a pad unit of a first electronic component and a pad unit of a second electronic component such that the pad unit of the first electronic component and the pad unit of the second electronic component are disposed to face each other with a conductive adhesion film therebetween, the conductive adhesion film including an adhesion resin layer, conductive balls dispersed in the adhesion resin layer, and curing agent capsules dispersed in the adhesion resin layer, the curing agent capsules including a curing initiator and a tube that seals the curing initiator, and the curing agent capsules being formed through a curing and coating process; and attaching the pad unit of the first electronic component to the pad unit of the second electronic component by applying a pressure, wherein attaching the pad unit of the first electronic component to the pad unit of the second electronic component includes:

pre-compressing the pad unit of the first electronic component to the pad unit of the second electronic component; and applying a pressure to the pad unit of the first electronic component and the pad unit of the second electronic component.

8. The method as claimed in claim 7, wherein applying the pressure to the pad unit of the first electronic component and the pad unit of the second electronic component includes applying a pressure of about 5 Mpa to about 150 Mpa.

9. The method as claimed in claim 8, wherein applying the pressure to the pad unit of the first electronic component and the pad unit of the second electronic component includes applying pressure such that the tube is broken.

10. The method as claimed in claim 9, wherein after the tube is broken, the curing initiator reacts with the adhesion resin layer to cure the adhesion resin layer.

11. The method as claimed in claim 7, wherein aligning the pad unit of the first electronic component and the pad unit of the second electronic component includes aligning an alignment mark of the first electronic component and an alignment mark of the second electronic component.

* * * * *